US007478655B2

(12) United States Patent
Nakajima

(10) Patent No.: US 7,478,655 B2
(45) Date of Patent: Jan. 20, 2009

(54) PRESS FABRIC FOR PULP MACHINE

(75) Inventor: Tatsutoshi Nakajima, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 11/797,551

(22) Filed: May 4, 2007

(65) Prior Publication Data

US 2008/0006340 A1 Jan. 10, 2008

(30) Foreign Application Priority Data

Jul. 7, 2006 (JP) ..... 2006-187789

(51) Int. Cl.
*D03D 3/04* (2006.01)
*D21F 7/08* (2006.01)
*D03D 25/00* (2006.01)

(52) U.S. Cl. ..... 139/383 A; 139/408; 139/413; 162/358.2; 442/203; 442/205

(58) Field of Classification Search ..... None
See application file for complete search history.

(56) References Cited

U.S. PATENT DOCUMENTS 3,885,602 A * 5/1975 Slaughter ..... 139/425 A
4,105,495 A * 8/1978 Pai ..... 162/348
4,119,753 A * 10/1978 Smart ..... 442/187
4,139,513 A * 2/1979 Tanaka et al. ..... 522/99
4,202,382 A * 5/1980 Westhead ..... 139/383 A
4,451,629 A * 5/1984 Tanaka et al. ..... 526/238.23
4,500,588 A * 2/1985 Lundstrom ..... 428/212
5,232,768 A * 8/1993 Eklund et al. ..... 442/225
5,274,893 A * 1/1994 Kitamura et al. ..... 28/105
5,601,691 A * 2/1997 Kufferath ..... 162/358.2
5,888,915 A * 3/1999 Denton et al. ..... 442/200
5,946,766 A * 9/1999 Kitamura et al. ..... 15/256.5
6,007,911 A * 12/1999 Bowen, Jr. ..... 428/373
6,092,298 A * 7/2000 Salminen et al. ..... 34/71

(Continued)

FOREIGN PATENT DOCUMENTS

WO WO 03/069056 A1 8/2003

OTHER PUBLICATIONS

Communication from European Patent Office for application No. 07252467.1-2314 dated Sep. 26, 2007.

*Primary Examiner*—Bobby H Muromoto, Jr.
(74) *Attorney, Agent, or Firm*—Rader, Fishman & Grauer, PLLC

(57) ABSTRACT

In a press fabric for a pulp machine having a multilayer structure, which fabric is woven using, as a warp, a monofilament as a warp and, as wefts, a yarn obtained by bundling raw yarns of a small diameter and forming a fine water sucking space therebetween and a monofilament, at least an upper surface side weft and a lower surface side weft are arranged vertically as the wefts; the yarns forming a fine water-sucking space and monofilament are used as wefts constituting the lower side layer; they are arranged at a ratio of 2:2 or 1:2; and two monofilaments are arranged adjacent to each other as the lower surface side wefts, whereby the press fabric can maintain its dewatering channel for discharging water to the back surface side from the initial stage to the final stage of use.

8 Claims, 2 Drawing Sheets

U.S. PATENT DOCUMENTS 6,171,446 B1 * 1/2001 Diaz-Kotti ..... 162/358.2
6,223,781 B1 * 5/2001 Yamada et al. ..... 139/383 AA
6,234,213 B1 * 5/2001 Kobayashi et al. ..... 139/383 A
6,284,678 B1 * 9/2001 Kobayashi et al. ..... 442/207
6,397,899 B1 * 6/2002 Kobayashi et al. ..... 139/383 A
6,510,873 B2 * 1/2003 Nagura ..... 139/383 A
6,860,299 B2 * 3/2005 Kuji ..... 139/383 A
7,108,019 B2 * 9/2006 Nagura et al. ..... 139/383 A
7,135,096 B2 * 11/2006 Despault et al. ..... 162/358.2
7,175,743 B2 * 2/2007 Murakami ..... 162/348
7,216,677 B2 * 5/2007 Fujisawa ..... 139/383 A
7,270,151 B2 * 9/2007 Nagura et al. ..... 139/383 A
7,270,152 B2 * 9/2007 Ueda et al. ..... 139/383 A
7,306,014 B2 * 12/2007 Nagura et al. ..... 139/383 A
2003/0084952 A1 * 5/2003 Burazin et al. ..... 139/383 A
2003/0084953 A1 * 5/2003 Burazin et al. ..... 139/383 A
2006/0085999 A1 * 4/2006 Scherb et al. ..... 34/453
2006/0106176 A1 * 5/2006 Murakami ..... 525/432
2006/0112999 A1 * 6/2006 Nagura et al. ..... 139/383 A
2006/0116042 A1 * 6/2006 Nagura et al. ..... 442/205
2006/0260708 A1 * 11/2006 Ueda et al. ..... 139/383 A
2006/0278295 A1 * 12/2006 Ueda et al. ..... 139/383 A
2006/0278296 A1 * 12/2006 Ito ..... 139/383 A
2006/0278297 A1 * 12/2006 Ueda ..... 139/383 A
2007/0095416 A1 * 5/2007 Ueda ..... 139/383 A
2007/0095417 A1 * 5/2007 Fujisawa ..... 139/383 A
2007/0128414 A1 * 6/2007 Nakajima ..... 428/194
2007/0128415 A1 * 6/2007 Nakajima et al. ..... 428/194
2008/0006340 A1 * 1/2008 Nakajima ..... 139/383 A

* cited by examiner

PRESS FABRIC FOR PULP MACHINE

BACKGROUND OF THE INVENTION

1. Field of the Invention

The present invention relates to a press fabric for a pulp machine which is used at the press portion of the pulp machine and excellent in water sucking property, dewatering property, washability and shower resistance.

2. Description of the Related Art

A pulp sheet is a sheet composed of fibers derived from wood and it is used as a raw material of paper. For facilitating the handling during transport or storage, fibers are formed into a sheet. A pulp manufacturing process is well known and it is the common practice to supply raw materials containing pulp fibers and the like to an endless fabric put on rolls and running therebetween and remove a certain amount of water from them by a dewatering machine or the like while transferring them.

The pulp sheet thus formed is then transferred to a press section and, if necessary, to a dryer section. At the press section, the pulp sheet is transferred by means of a felt for pressing and while passing through a series of press nips constituted by the combination of the felt and press rolls, it is dewatered. Dewatering is achieved, for example, by a double wire press capable of carrying out sheet formation and pressing simultaneously or a heavy duty press utilizing a high-pressure press. In the double wire press or heavy duty press, a method of placing a pulp sheet between two felts or fabrics and squeezing water from the sheet under a nip pressure is employed. At the dryer section, the pulp sheet is dried while being transferred by means of a canvas, whereby a pulp sheet which can be handled easily is formed.

Felts and woven fabrics have conventionally been used as a water sucking medium at the press section. A needle felt is formed by needling a batt of synthetic fibers on the front and back surfaces of a base cloth woven with monofilaments or multifilaments, thereby interlocking them. Since it has a structure filled, from the front surface to the back surface thereof, with a batt of fine synthetic fibers, it permits smooth passage of water without resistance and is therefore suited as a water sucking medium. Owing to the structure filled with a batt of fine synthetic fibers, however, dirt, fine fibers, chemicals and the like penetrated into the needle felt cannot be removed easily and moreover, a high-pressure shower for flushing them away has an impact on it and sometimes breaks and makes a hole in it. In addition to these problems, owing to poor cushioning property and nip resistance, the batt is gradually flattened and compressed, leading to deterioration in the water sucking property. The needle felt is a water sucking medium excellent in water sucking property, but has several serious problems in washability, rigidity, size stability, productivity and increase in electric load.

A fabric formed of monofilaments as warps and monofilaments and multifilaments as wefts and having the multifilaments protruded from the surface of the fabric is therefore developed and disclosed in Japanese Patent Laid-Open No. 2002-105884 (corresponding U.S. Pat. No. 6,510,873). This fabric efficiently transfers, to a press fabric, unnecessary water squeezed out of a pulp sheet under a nip pressure by pressing, allows yarns running from the front surface to the back surface of the press fabric and having fine water-sucking spaces to function as a continuous conduit, concentrates water to the running surface side of the press fabric by a capillary phenomenon or the like, and brings the yarns having a fine water-sucking space into contact with rolls to remove water thus collected on the running surface side. Compared with the felt which may have a hole in the batt as described above, the fabric press has improved water sucking property and size stability.

This press fabric has, on the lower side layer thereof, a structure in which multifilaments having a fine water-sucking space and monofilaments have been arranged alternately so that unnecessary water of the pulp sheet is transferred to the lower surface side of the press fabric efficiently by a capillary phenomenon and water collected on the running surface side is discharged by bringing the yarns having a fine water-sucking space, which are on the lower surface side, into contact with rolls.

By a press pressure during using, the yarns having a fine water-sucking space are flattened and widened to block the network serving as dewatering channels. Despite the initial usability, their water sucking property and dewatering property deteriorate gradually. Yarns having a fine water-sucking space are excellent in cushioning property so that they have excellent water sucking property, but gradual flattening by a press is an inevitable structural problem for them. There is therefore a demand for the development of a press fabric for a pulp machine which enables efficient dewatering of a pulp sheet for a long period of time.

SUMMARY OF THE INVENTION

An object of the present invention is to provide a press fabric for a pulp machine excellent in water sucking property, dewatering property, washability and shower resistance and can retain desired physical properties for a long period of time.

Considering that insufficient dewatering of a pulp sheet which poses a problem in the conventional press fabric is caused by blocking of a dewatering channel on the back surface of the fabric (the term "back surface of the fabric" as used herein means a surface on the side which a press roll is brought into contact with and is also called a "lower side surface", while the term "front surface of the fabric" means a surface on the side which the pulp sheet is brought into contact with and is also called an "upper side surface"), the present inventors have succeeded in the development of a press fabric for a pulp machine having a structure capable of retaining a water drainage space even in the middle period or end-period of use. In the present invention, the below-described constitution is employed in order to overcome the above-described problems.

The invention of this application relates to a press fabric for a pulp machine having a multilayer structure obtained by weaving, as warps, monofilaments with, as wefts, yarns obtained by bundling raw yarns of a small diameter and forming a fine water-sucking space therebetween and monofilaments. At least upper surface side wefts and lower surface side wefts are arranged vertically as the wefts. The yarns forming a fine water-sucking space and monofilaments are used as the lower surface side wefts at a ratio of 2:2 or 1:2. As the lower surface side wefts, two monofilaments are arranged adjacent to each other.

The yarns forming a fine water-sucking space or the yarns forming a fine water-sucking space and monofilaments may be used as the upper surface side wefts. The lower surface side wefts may have a design of going under a plurality of warps to form a long crimp on the lower side surface. The upper surface side wefts may have a design of passing over a plurality of warps to form a long crimp on the upper side surface.

At least a portion of the yarns forming a fine water-sucking space and monofilaments used as the warps or wefts may be made of polyamide. The press fabric for a pulp machine as described above may have a single warp-double weft structure, a single warp-triple weft structure, a double warp-double weft structure or a double warp-triple weft structure.

The upper surface side wefts and the lower surface side wefts may be arranged at a ratio of from 1:1 to 2:1. The yarns forming a fine water-sucking space may be selected from a multifilament, a spun yarn, a raised yarn, a monofilament twisted yarn, a chenille yarn, a filament-processed yarn, a yarn obtained by winding a spun yarn on a core of monofilament, a yarn obtained by winding a multifilament on a core of monofilament, and a yarn obtained by twisting two or more of these yarns together. Each of the monofilaments serving as the warps may be either a monofilament twisted yarn or a twisted yarn having a monofilament as a core.

Since the press fabric of the present invention uses yarns obtained by bundling raw yarns of a small diameter and forming a fine water-sucking space therebetween and monofilaments as wefts constituting the lower side layer and has a structure wherein they are arranged at a ratio of 2:2 or 1:2 and two monofilaments serving as lower surface side wefts are arranged adjacent to each other, blocking of a dewatering channel can be prevented. As a result, deterioration in the water sucking performance and dewatering performance of the press fabric can be retarded, whereby the water content of a pulp sheet can be retained at a usable level for a long period of time.

DESCRIPTION OF THE INVENTION

Figure 1:
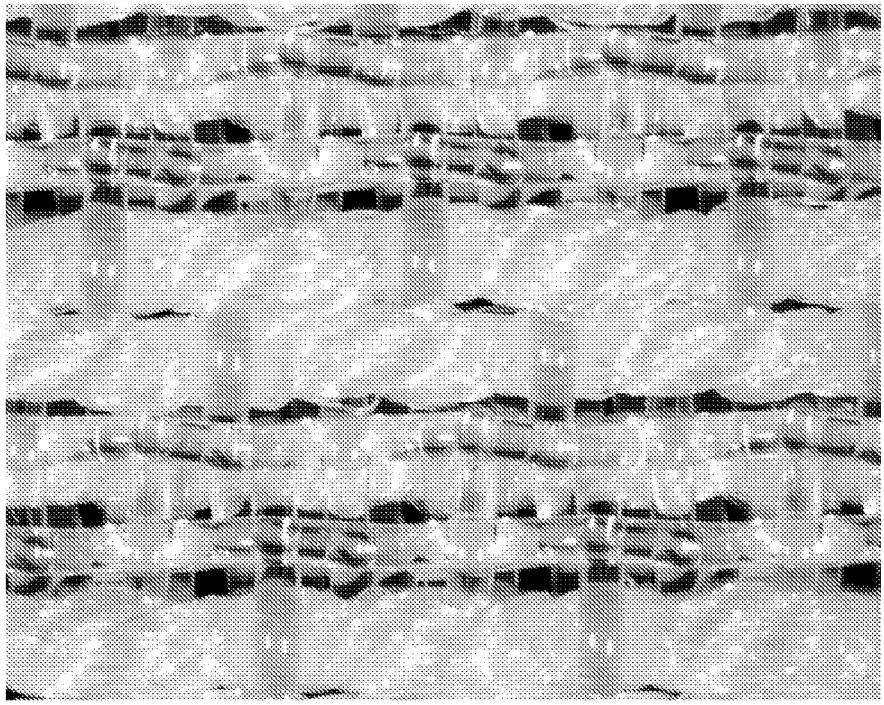
FIG. 1 is a photograph of the surface on the back surface side of the press fabric for a pulp machine according to the present invention prior to use.

In the conventionally used press fabric, deterioration of the dewatering property occurs in about one month after its use is started. The dewatering performance gradually deteriorates while reducing the deterioration speed. The press fabric outlives its usefulness at the time when the water content of a pulp sheet exceeds a satisfactory level. The present inventors have therefore developed a press fabric capable of retarding the initial deterioration of its dewatering performance and maintaining the water content of a pulp sheet at a practically usable level for a long period of time.

In the press fabric of the present invention, monofilaments serving as warps are woven with wefts. This fabric is made endless by interweaving the end portions of warps each other and caused to travel continuously under a tension in the warp direction. Use of monofilaments having rigidity as warps makes it possible to prevent stretching or deformation. A weft has a multilayer structure in which at least an upper surface side weft and a lower surface side weft are arranged vertically and they are woven by a warp. Since the weft has a multilayer structure, water is absorbed from a pulp sheet in the upper side layer and is removed efficiently in the lower side layer.

Lower surface side wefts are formed of two yarns, that is, a monofilament and a yarn forming a fine water-sucking space. Two monofilaments and two yarns forming a fine water-sucking space are arranged alternately or two monofilaments and one yarn forming a fine water-sucking space are arranged. Use of the yarn forming a fine water-sucking space provides the fabric with sufficient water retention property and water sucking property, while use of the monofilament provides the fabric with rigidity and at the same time, washability and resistance to high-pressure washing. What is important in this invention is that two monofilaments serving as lower surface side wefts are arranged adjacent to each other. The yarn forming a fine water-sucking space is flattened and widened by pressing, while the monofilament is not flattened so much by pressing. Even if the yarn forming a fine water-sucking space is flattened and widened by pressing of the fabric, the dewatering channel between two monofilaments can be maintained without being flattened. The yarn arranged on the upper side layer and forming a fine water-sucking space is pressed while being brought into contact with a pulp, which is soft, so that even if the yarn forming a fine water-sucking space is flexible, severe flattening and deformation do not occur. On the other hand, the yarn forming a fine water-sucking space on the lower side layer is pressed while being brought into contact with a hard press roll made of, for example, iron so that it is flattened and widened inevitably.

The term "dewatering channel" as used herein means a space formed between the lower side surface wefts. It is a channel extending in a weft direction. Through this space, water is removed from the press fabric. This space is formed by two lower surface side wefts which are adjacent to each other but pass over and under respectively different warps. It is possible to confirm the presence of dewatering channels between wefts though their size is not uniform unless the fabric has only yarns forming a fine water-sucking space as wefts. When yarns which are easily flattened and widened are used, the dewatering channel has a relatively small size or sometimes cannot be observed visually owing to the properties of the yarns.

In order to maintain the dewatering property until the final stage of the life of the press fabric, it is important to maintain the structure of the dewatering channel. If the wefts are all made of monofilaments, the dewatering channel can be maintained until the final stage of the life of the press fabric but such a fabric does not have a sufficient water sucking property. It is very important to find yarns and arrangement design thereof suited for accomplishing both the dewatering property and water sucking property in order to efficiently discharge water from the fabric.

In the press fabric for a pulp machine, dewatering of a pulp sheet is carried out variously, for example, by gravity dewatering, centrifugal dewatering or pressing. In any dewatering method, dewatering by using a dewatering channel formed between two monofilaments on the lower surface side becomes necessary to efficiently remove water retained in the layer of the fabric. When the number of monofilaments serving as the lower surface side weft is one, a satisfactory dewatering channel cannot be formed because yarns forming a fine water-sucking space and present on both sides of the monofilament are flattened to fill the space therewith. When three monofilaments are used as the lower surface side weft, deterioration in water sucking property occurs because of a decrease in a ratio of the yarns forming a fine water-sucking space. It is therefore preferred that relative to two monofilaments, two yarns forming a fine water-sucking space may be arranged adjacent to each other or one yarn forming a fine water-sucking space may be arranged. In the conventional press fabric, it is also possible to have a dewatering channel between wefts by decreasing the density (the number) of wefts, but in this case, a reduction in the density of wefts of the whole press fabric leads to deterioration in rigidity. As a result, the press fabric fails to maintain its shape and changes its shape or it cannot apply a sufficient pressure onto the pulp sheet and fails to reduce the water content of a pulp sheet. The structure of the present invention in which two monofilaments are arranged each other makes it possible to ensure a dewatering channel while maintaining the density of wefts at a level comparable to that of the conventional press fabric.

As wefts constituting the upper side layer, yarns forming a fine water-sucking space or both the yarns forming a fine water-sucking space and monofilaments may be used. The yarns forming a fine water-sucking space as upper surface side wefts receive water directly from a pulp sheet so that they must have a fine water-sucking space. In a fabric having a double weft structure, yarns forming a fine water-sucking space may be placed as both of the upper surface side weft and lower surface side weft. In a fabric having a triple weft structure, yarns forming a fine water-sucking space may be placed as at least a portion of upper surface side wefts, middle wefts and lower surface side wefts. Such a structure makes it possible to form a fine water drainage space connected by yarns forming a fine water-sucking space from the upper side layer to the lower side layer, thereby transferring water efficiently from the upper side layer to the lower side layer by means of the capillary phenomenon.

For efficient water sucking, it is important that a pressure fluid gradient passing through a pulp sheet and press fabric is high under a nip pressure, in other words, a force of water running from the pulp sheet toward the press fabric is large. It is apparent that water is smoothly squeezed when the resistance against running water is small. When the press fabric has an adequately dense surface, the re-absorption of water by the pulp sheet at the outlet side of the press nip can be reduced. The water sucking property and cushioning property have a close relationship. Yarns obtained by bundling raw yarns of a small diameter and having a fine water-sucking space therebetween have adequate cushioning property so that they can exhibit a water sucking effect at the time when they restore to a state before compression. They can also buffer the press nip action by adequate compressive elasticity, whereby breakage or the like of the pulp sheet does not occur easily.

The press fabric woven using, as wefts, yarns obtained by bundling raw yarns of a small diameter and having a fine water-sucking space therebetween is, similar to a batt of a needle felt, an aggregate of fine fibers but has a woven mesh structure as a whole so that wefts are woven by warps or warps are woven by wefts and they are constrained strongly each other on a short cycle so that the fabric has excellent rigidity and does not have a thinning tendency compared with a felt. As a result, the water-sucking spaces are not flattened completely or the yarns are neither broken nor lost by the impact of shower water. The press fabric of the present invention does not adopt a needle-felt like structure dense with fine fibers in an entire direction of Z axis but adopts a fabric structure in which an aggregate of fine fibers is constrained strongly so that the fabric has openings by which dirt does not accumulate on the fabric. In addition, yarns obtained by bundling raw yarns of a small diameter and having a fine water-sucking space therebetween have good shower resistance so that it can bear high pressure shower.

It is recommended to use, as upper surface side wefts on the upper side layer, many yarns forming a fine water-sucking space in consideration of water sucking property. For example, all the upper surface side wefts may be yarns forming a fine water-sucking space. When rigidity and an endless weaving and connecting property of end portions of warps are taken into consideration, arrangement of monofilaments for interweaving facilitates endless weaving. The monofilaments and the yarns forming a fine water-sucking space are arranged at any ratio insofar as the fabric has the latter one.

The upper surface side wefts and lower surface side wefts are arranged preferably at a ratio of from 1:1 to 2:1. When the number of the lower surface side wefts is made smaller than that of the upper surface side wefts, the lower surface bide wefts have a wider space therebetween, making it possible to secure a greater dewatering space. This however decreases the absolute number of yarns forming a fine water-sucking space, leading to deterioration in water retention and water sucking property. It is therefore necessary to determine an arrangement ratio while taking various conditions such as the number of warps to be set, the number of wefts inserted, diameter of yarn and properties of yarn into consideration.

The structure of the fabric is, for example, a single warp double weft structure, single warp triple weft structure, double warp double weft structure and double warp and triple weft structure. It is not limited insofar as wefts of it are each composed of at least two layers.

No particular limitation is imposed also on the fabric design. A design in which an upper surface side weft passes over a plurality of warps to form a long crimp on the upper side surface facilitates transfer of water from the pulp to the fabric. When the fabric has, on the lower side layer, a design in which a lower surface side weft passes under a plurality of warps to form a long crimp on the lower side surface, yarns obtained by bundling raw yarns of a small diameter and forming a fine water-sucking space between the raw yarns, which yarns are present on the running surface side, form a wide contact surface with a roll so that transfer of water to the roll occurs fully and the fabric can have a good water sucking property. In addition, the resulting fabric has abrasion resistance superior to that of the conventional fabric because of the design with a weft long crimp.

When a space is formed between monofilaments serving as lower surface side wefts, a design in which two monofilaments adjacent to each other pass over and under the same warp is not preferred because of difficulty in forming a space between the monofilaments.

Examples of the above-described yarn obtained by bundling raw yarns of a small diameter and having a fine water-sucking space therebetween include a spun yarn, multifilament, a raised yarn, a monofilament twisted yarn, a chenille yarn, a filament-processed yarn, a yarn obtained by winding a spun yarn on a core of monofilament, a yarn obtained by winding a multifilament on a core of monofilament, and a yarn obtained by twisting two or more of these yarns together. The term "spun yarn" as used herein means a yarn formed by gathering and bundling short fibers, and it includes a yarn manufactured by spinning, or the like. The term "multifilament" means a yarn formed by gathering and bundling fine short fibers; the term "raised yarn" means a yarn formed by scratching the surface of a multifilament with a needle like material to cause nap; the term "filament-processed yarn" means a yarn formed by subjecting a filament yarn to expansion and contraction processing, bulking processing, crimp processing, or the like, and it includes yarns generally called as textured yarn, bulky yarn, stretcher yarn, and Taslan processed yarn, as well as wooly nylon and the like; the term "chenille yarn" means a yarn formed by arranging short fibers radially with a core yarn such as multifilament as an inner core and it includes a yarn obtained by subjecting short fibers arranged radially to crimp processing or the like.

The monofilament may be a monofilament-twisted yarn or a twisted yarn having a monofilament as a core. The monofilament used in such a yarn is effective for improving the rigidity and size stability.

No particular limitation is imposed on the material of the yarn and various materials such as synthetic fibers including polyesters, polyamides and polyphenylene sulfide, chemical fibers including rayon, and natural fibers including cotton can be used. Use of a polyamide for yarns is preferred because the resulting fabric can have satisfactory nip resistance and fibrillation resistance which will otherwise occur upon pressing. Even strong pressing does not cause cracks of it. When polyester is used, the resulting fabric has increased rigidity and becomes resistant to stretching and deformation. Therefore, it is preferable to select the material of the yarn depending on its using purpose. In particular, use of a polyamide monofilament as the yarn forming a fine water-sucking space and monofilament serving as wefts is suited to avoid the problem of cracks.

EXAMPLES

A fabric for a pulp machine according to the present invention and a fabric for a pulp machine according to a conventional example were used practically in a pulp manufacturing machine and the state of the back surface after use and water content of the pulp sheet at that time were analyzed to compare these two fabrics.

In Example of the present invention, a polyamide monofilament having a diameter of 0.62 mm was arranged as a warp; a polyamide monofilament having a diameter of 0.50 mm and a polyamide multifilament having a diameter of 1.30 mm were arranged alternately at a ratio of 1:1 as upper surface side wefts; and a polyamide monofilament having a diameter of 0.50 mm and a polyamide multifilament having a diameter of 1.30 mm were arranged at a ratio of 2:2 as lower surface side wefts, whereby a fabric having a single warp-double weft structure was obtained.

In a similar manner to Example except that the monofilament and multifilament of the lower surface side weft were arranged at a ratio of 1:1, a press fabric of the conventional example was obtained.

Figure 2:
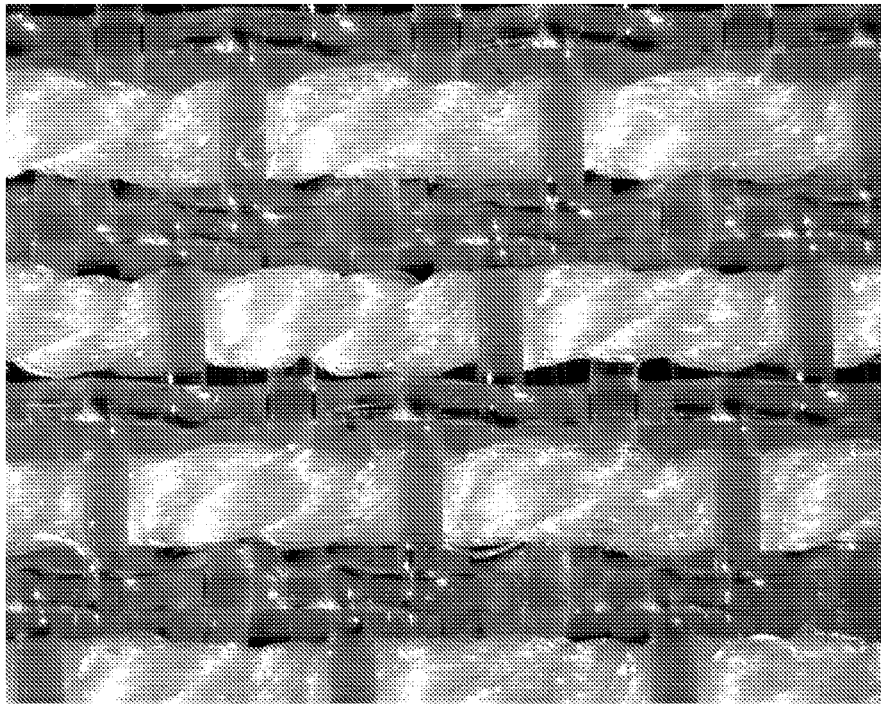
FIG. 2 PRIOR ART
FIG. 2 is a photograph of the surface on the back surface side of the press fabric for a pulp machine according to the conventional example prior to use.

FIG. 1 is a photograph of the surface on the back surface side of the press fabric for a pulp machine according to the present invention prior to use. The fabric has a dewatering channel between two monofilaments and moreover, has an opening between multiflaments, though it is small. FIG. 2 is a photograph of the surface on the back surface side of the press fabric for a pulp machine according to the conventional example prior to use. This photograph suggests that the fabric has a dewatering channel between the monofilament and multiflament arranged one by one alternately.

The press fabrics obtained in Example and Conventional Example were used on a practical pulp machine. For comparing these two fabrics, the water content of the pulp sheet was measured and the state of the back surface after use was analyzed.

Figure 3:
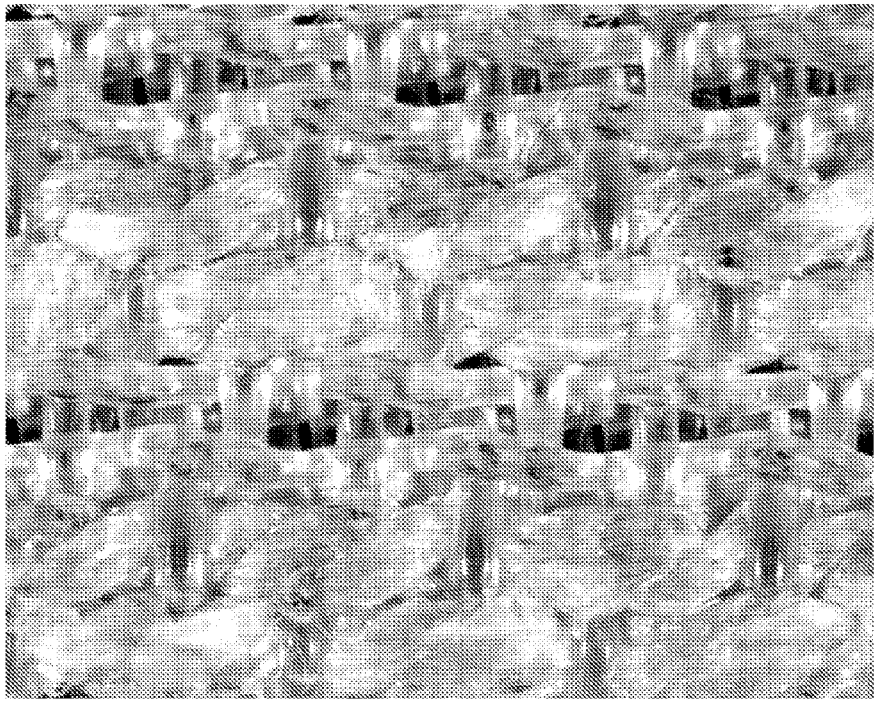
FIG. 3 is a photograph of the surface on the back surface side of the press fabric according to the present invention after 12 months use on a pulp manufacturing machine.

FIG. 3 is a photograph of the surface on the back surface side of the press fabric of the present invention shown in FIG. 1 after 12-months use in a pulp manufacturing machine. The multifilaments were flattened and widened and a dewatering channel between them was blocked. A dewatering channel present between two monofilaments was, on the other hand, still present and a water content of the pulp sheet was kept at from 57 to 59%, which was on the target level, for a long period of time. Six months after that, the water content of the pulp sheet exceeded 60% and the cushioning property of the multifilament deteriorated so that it was judged that the fabric outlived its usefulness.

Figure 4:
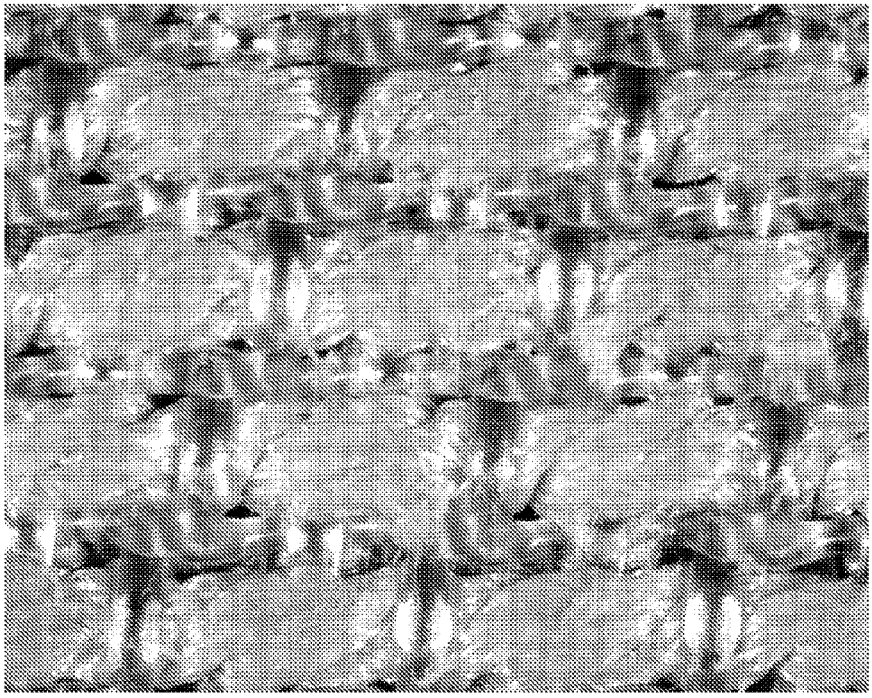
FIG. 4 PRIOR ART
FIG. 4 is a photograph of the surface on the back surface side of the press fabric of the Conventional Example after 60 days use on a pulp manufacturing machine.

FIG. 4 is a photograph of the surface on the back surface side of the press fabric of the Conventional Example shown in FIG. 2 after use in a pulp manufacturing machine for 60 days. Space of wefts was completely blocked by the multifilaments flattened and widened, which can be clearly understood from the comparison with the photograph of FIG. 2 prior to use. The water content of the pulp sheet was from 57 to 59% within about one month after the use of the fabric was started, but owing to gradual deterioration in dewatering property, the water content exceeded 60% after 6 months so that it was judged that the fabric outlived its usefulness.

It has accordingly been elucidated that in the press fabric for a pulp machine, maintenance of a dewatering space on the back surface side is a very important factor for carrying out efficient dewatering of the pulp sheet. It is apparent that arrangement of a multifilament which is one of yarns forming a fine water-sucking space and a monofilament under the most suited condition influences whether the resulting press fabric can keep desired physical properties for a long period of time or not.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2006-187789 filed Jul. 7, 2006 including specification, drawings and claims is incorporated herein by reference in its entirety.

What is claimed is:

1. A press fabric for a pulp machine having a multilayer structure obtained by weaving warps, each of which is selected from a group consisting of a monofilament, monofilament twisted yarn and a twisted yarn having a monofilament as a core, with as wefts, yarns obtained by bundling raw yarns of a small diameter and forming a fine water-sucking space therebetween and monofilaments, wherein at least upper surface side wefts and lower surface side wefts are arranged vertically as the wefts;

one of the weft yarns forming a fine water-sucking space or two of the weft yarns forming a fine water-sucking space which are adjacent to each other, and two of the monofilaments which are adjacent to each other, are alternatively arranged as the lower surface side wefts.

2. A press fabric for a pulp machine according to claim 1, wherein the weft yarns forming a fine water-sucking space or the weft yarns forming a fine water-sucking space and monofilaments are used as the upper surface side wefts.

3. A press fabric for a pulp machine according to claim 1, wherein the lower surface side wefts have a design of going under a plurality of warps to form a long crimp on the lower side surface.

4. A press fabric for a pulp machine according to claim 1, wherein the upper surface side wefts have a design of passing over a plurality of warps to form a long crimp on the upper side surface.

5. A press fabric for a pulp machine according to claim 1, wherein at least a portion of the weft yarns forming a fine water-sucking space and monofilaments used as the warps or wefts is made of polyamide.

6. A press fabric for a pulp machine according to claim 1, which has a single warp-double weft structure, a single warp-triple weft structure, a double warp-double weft structure or a double warp-triple weft structure.

7. A press fabric for a pulp machine according to claim 1, wherein the upper surface side wefts and the lower surface side wefts are arranged at a ratio of from 1:1 to 2:1.

8. A press fabric for a pulp machine according to claim 1, wherein the weft yarns forming a fine water-sucking space is selected from a multifilament, a spun yarn, a raised yarn, a monofilament twisted yarn, a chenille yarn, a filament-processed yarn, a yarn obtained by winding a spun yarn on a core of monofilament, a yarn obtained by winding a multifilament on a core of monofilament, and a yarn obtained by twisting two or more of these yarns together.

* * * * *